United States Patent [19]

Verachtert

[11] Patent Number: 4,626,341

[45] Date of Patent: Dec. 2, 1986

[54] PROCESS FOR MERCAPTAN EXTRACTION FROM OLEFINIC HYDROCARBONS

[75] Inventor: Thomas A. Verachtert, Wheeling, Ill.

[73] Assignee: UOP Inc., Des Plaines, Ill.

[21] Appl. No.: 812,160

[22] Filed: Dec. 23, 1985

[51] Int. Cl.[4] ..... C10G 19/02; C10G 19/08

[52] U.S. Cl. ..... 208/235; 208/189; 208/231

[58] Field of Search ..... 208/189, 192, 193, 200, 208/230, 231, 235; 585/854

[56] References Cited

U.S. PATENT DOCUMENTS

| | | | |
|---|---|---|---|
| 2,365,993 | 12/1944 | Apgar | 208/189 |
| 2,428,623 | 10/1947 | Hewlett et al. | 208/235 X |
| 2,740,749 | 4/1956 | Megverian et al. | 208/235 X |
| 2,871,194 | 1/1959 | Meadows | 208/235 X |
| 2,921,020 | 1/1960 | Urban et al. | 208/205 |
| 3,107,213 | 10/1963 | Cole et al. | 208/231 X |
| 3,574,093 | 4/1971 | Strong | 208/206 |
| 3,909,395 | 9/1975 | Takacs | 208/189 X |
| 3,923,645 | 12/1975 | Anderson, Jr. et al. | 208/206 |
| 4,362,614 | 12/1982 | Asdigian | 208/230 X |
| 4,404,098 | 9/1983 | Asdigian | 208/235 |

FOREIGN PATENT DOCUMENTS

| | | | |
|---|---|---|---|
| 507179 | 11/1954 | Canada | 208/235 |
| 563032 | 9/1958 | Canada | 208/235 |
| 759156 | 10/1956 | United Kingdom | 208/189 |
| 795762 | 5/1958 | United Kingdom | 208/189 |

OTHER PUBLICATIONS

Kirk-Othmer Encyclopedia of Chemical Technology, vol. 15, pp. 51-52, "Petroleum (Refinery Processes)".

*Primary Examiner*—Andrew H. Metz
*Assistant Examiner*—Glenn A. Caldarola
*Attorney, Agent, or Firm*—Thomas K. McBride; John F. Spears, Jr.

[57] ABSTRACT

A process is disclosed for removing mercaptans from highly olefinic feed streams by extraction with an aqueous alkaline solution. The aqueous solution is preferably regenerated by oxidation of extracted mercaptans to disulfides. The invention employs two extraction steps performed on the aqueous solution to limit the passage of olefins or acetylenes into the mercaptan conversion zone and to limit the passage of mercaptans and/or oxygenates into the primary extraction zone.

24 Claims, 1 Drawing Figure

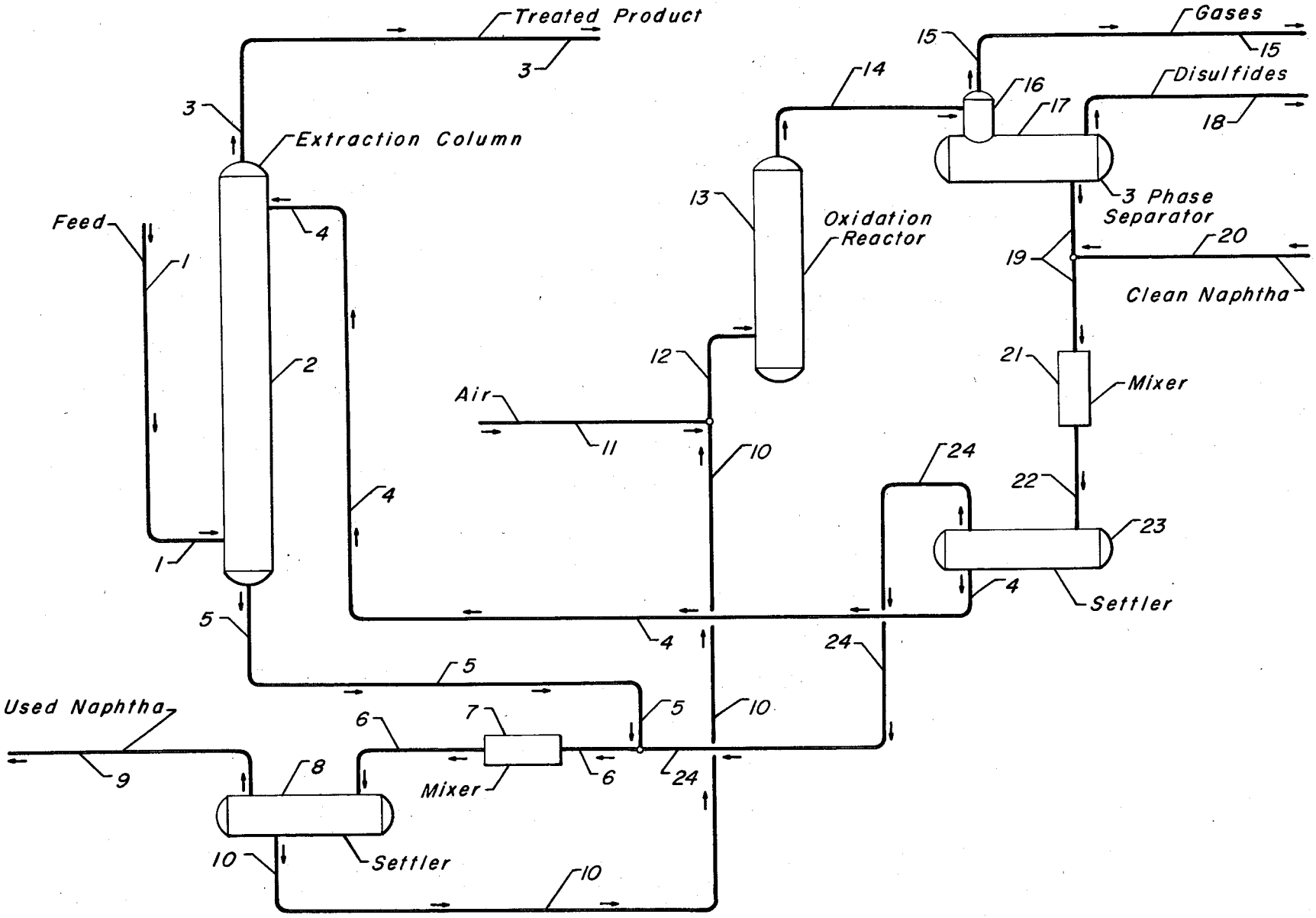
Gases
Disulfides
3 Phase Separator
Clean Naphtha
Mixer
Settler
Oxidation Reactor
Treated Product
Extraction Column
Air
Mixer
Settler
Feed
Used Naphtha

PROCESS FOR MERCAPTAN EXTRACTION FROM OLEFINIC HYDROCARBONS

FIELD OF THE INVENTION

The invention relates to a hydrocarbon treating process. The subject treating process is concerned with the removal or elimination of mercaptan compounds from hydrocarbon feed streams. The subject invention therefore relates to the hydrocarbon treating process referred to as mercaptan extraction and in which a hydrocarbon feed stream is contacted with an aqueous alkaline solution which extracts the mercaptans from the hydrocarbon feed stream. The invention is specifically concerned with the steps employed in handling the aqueous alkaline solution used in this extraction procedure. The subject invention may be further characterized as relating to the extractive removal of mercaptans from highly olefinic hydrocarbon feed streams including those which contain significant amounts of acetylene hydrocarbon.

PRIOR ART

The extraction of mercaptans from hydrocarbon streams is widely practiced in the petroleum refining industry and is probably performed in most of the world's major petroleum refineries. It is described in basic reference sources such as Volume 15 of the second edition of the *Kirk-Offner Encyclopedia of Chemical Technology.* This reference shows the basic mercaptan extraction process in which a hydrocarbon feed stream is passed through an extraction column countercurrent to a descending stream of lean aqueous alkaline solution normally referred to in the art as caustic. The treated product is removed from the top of the extraction column. A mercaptan-containing caustic solution referred to as a "rich" caustic solution is removed from the bottom of the extraction column and passed into an oxidation zone in admixture with air. An oxidation catalyst dissolved in the caustic solution promotes the oxidation of the extracted mercaptans to disulfide compounds within the oxidation zone. The effluent stream of the oxidation zone is passed into a phase separation vessel from which the disulfide compounds are decanted. This procedure serves to remove the mercaptan compounds from the rich caustic stream and is therefore referred to as "regeneration" of the caustic. The resultant "lean" caustic is removed from the separation vessel and recycled to the extraction column. A more detailed description of a modern mercaptan extraction process is provided in U.S. Pat. No. 4,404,098 issued to G. S. Asdigian.

It is known to the those skilled in the art that a good separation of the disulfide compounds from the caustic solution is required in order to minimize the content of disulfides in the caustic being recirculated to the extraction zone. The disulfide oils are soluble in hydrocarbon streams. Therefore, disulfide compounds present in the regenerated caustic being fed to the top of extraction column will become dissolved in the hydrocarbon stream which is being treated. This will raise the sulfur content of the treated hydrocarbon stream and may be totally unacceptable. It is known in the art to counteract this effect by removing disulfide compounds from the regenerated caustic. The regenerated caustic or regenerated aqueous alkaline solution may therefore be processed as in U.S. Pat. No. 2,921,020 issued to P. Urban et al. which describes the use of a disulfide removal zone 26. In this zone, the regenerated caustic is contacted with a hydrocarbon distillate such as pentane or hexane. The caustic solution is then passed into the extraction zone.

The use of a naphtha wash of the regenerated caustic is described in FIG. 1 of U.S. Pat. No. 3,923,645 issued to G. P. Anderson, Jr. et al. The use of a naphtha wash is also disclosed in U.S. Pat. No. 3,574,093 issued to J. R. Strong. This latter reference indicates that a process stream or a stream which is being treated can actually be employed as the hydrocarbon liquid used to remove disulfide compounds from the regenerated caustic solution. It is also known in the art to pass the wash hydrocarbon stream into the separation vessel from which the disulfide oil phase is removed rather than contacting the aqueous solution withdrawn from this vessel in a separate step.

BRIEF SUMMARY OF THE INVENTION

The invention is a process for extracting mercaptans from a highly olefinic hydrocarbon feed stream, which normally contains significant amounts of hydrocarbons having multiple double bonds and hydrocarbons having triple bonds also referred to as acetylene hydrocarbons. A typical feed stream would therefore contain such compounds butadiene, butyne, vinyl acetylene, propyne, and various other $C_3$ and $C_4$ olefinic and paraffinic hydrocarbons. In the subject process the rich mercaptan-containing caustic solution removed from the mercaptan-extraction column is contacted with a hydrocarbon stream in a second extraction zone for the purpose of removing acetylene and other reactive hydrocarbons from the caustic solution. The caustic solution is then passed into an oxidation zone or other mercaptan conversion zone. The caustic solution is then collected by decantation and contacted with a hydrocarbon stream in a third extraction zone to reduce the sulfur content of the thus regenerated caustic solution. The removal of the olefinic or acetylene hydrocarbons from the rich caustic solution prevents or reduces the rather severe polymerization which would normally occur within a mercaptan oxidation reactor when treating a highly olefinic hydrocarbon feed stream according to the prior art process.

One broad embodiment of the invention may be broadly characterized as a process for treating highly olefinic hydrocarbon feed streams by removing mercaptan compounds which comprises the steps of contacting a feed stream which comprises a saturated feed hydrocarbon having a boiling point below about 230° C. and which also comprises at least 5 mole percent olefinic hydrocarbons and at least 1 mole percent total diolefinic and acetylene hydrocarbons with a hereinafter characterized regenerated aqueous alkaline solution in a first extraction zone and thereby forming a product hydrocarbon stream and a mercaptan-rich aqueous alkaline solution which comprises a minor concentration of diolefinic hydrocarbons and acetylene hydrocarbons; removing diolefinic and acetylene hydrocarbons from the mercaptan-rich aqueous alkaline solution by contacting the mercaptan-rich aqueous alkaline solution with a treating hydrocarbon stream in a second extraction zone and thereby forming a treated mercaptan-rich aqueous alkaline solution; passing the treated mercaptan-rich aqueous alkaline solution into a mercaptan conversion zone in which mercaptans are converted to hydrocarbon soluble sulfur-containing chemical compounds, and producing a conversion zone effluent stream which comprises said sulfur-containing chemical compounds and an aqueous alkaline solution; and, separating a majority of said sulfur-containing chemical compounds from the conversion zone effluent stream in a separation zone and thereby forming said regenerated aqueous alkaline solution. Other embodiments described herein employ a third extraction zone to treat the regenerated aqueous alkaline solution.

BRIEF DESCRIPTION OF THE DRAWING

The drawing is a simplified process flow diagram showing mercaptans being extracted from the hydrocarbon feed stream of line 1 with the mercaptan-rich caustic solution formed thereby being contacted with a naphtha wash stream in a second extraction zone 8 prior to the passage of the mercaptan-rich caustic into the oxidation reactor 13.

DETAILED DESCRIPTION

Most distillate hydrocarbon streams produced from crude oil contain some amount of sulfur in one form or another unless these streams have been subjected to extensive sulfur removal procedures such as hydrotreating. Often a major amount of this sulfur is present in the form of a mercaptan. It is normally required to remove at least some portion of the mercaptan sulfur from the hydrocarbon distillate stream in order to meet certain product specifications such as a limitation on the total sulfur content of a product. It may also be desirable to remove mercaptan compounds from a hydrocarbon stream for the purpose of eliminating the rather malodorous mercaptan compounds and thereby improve or reduce the odor associated with the hydrocarbon stream. A third reason for removing mercaptan compounds from a hydrocarbon stream would be to eliminate the passage of sulfur-containing compounds into a catalyst bed which is sensitive to the presence of sulfur. It may therefore be necessary to remove mercaptans from a hydrocarbon distillate stream such as a butane or gasoline type stream or a petrochemical feed stream for the purpose of preserving the activity of a catalyst employed in a downstream conversion unit.

Mercaptans are commonly removed from hydrocarbon streams through the use of an extraction process in which the hydrocarbon stream is brought into contact with an aqueous alkaline solution. The mercaptans are preferentially dissolved in the aqueous alkaline solution and are thereby extracted from the hydrocarbon stream. The mercaptan-containing alkaline solution is then subjected to a procedure referred to as regeneration, which basically consists of oxidizing the mercaptans to disulfides and separating the disulfides from the aqueous solution by decantation in a phase separation zone. The aqueous solution is then recycled to the extraction zone.

It is believed that this form of extractive treating operation has not been successfully applied to a feed stream containing significant concentrations of highly reactive olefinic and acetylenic hydrocarbons. One reason for this is that olefinic and acetylinic hydrocarbons are more soluble in the aqueous alkaline solution than saturated hydrocarbons. Acetylene hydrocarbons are even more soluble in the aqueous solution. Therefore, in treating a highly olefinic hydrocarbon stream with the aqueous solution, a significant amount of the unsaturated hydrocarbons begins to enter the aqueous solution. This by itself will result in some loss of the hydrocarbon stream being treated. However, more importantly, the entrance of these unsaturated hydrocarbons into the commonly employed oxidation zone will result in a significant amount of polymerization occurring within the oxidation zone. This polymerization is undesirable as it results in a loss of the valuable olefinic hydrocarbons and may form polymers or polymeric deposits which can clog the equipment employed in the process and in other ways interfere with or degrade the performance of the overall treating process.

It is an objective of the subject invention to provide a process for extracting mercaptan compounds from a hydrocarbon stream. It is a further objective of the subject invention to provide a process for extracting mercaptans from a light hydrocarbon feed stream using an aqueous alkaline solution which is subsequently regenerated by the conversion of mercaptans to disulfide compounds. A specific objective of the subject invention is to provide an extractive treating process for naphtha boiling range or lighter feed stocks which contain at least 1 mole percent acetylenic hydrocarbons.

The subject invention is preferably directed to the treating of highly olefinic hydrocarbon feed streams. As used herein, the term "highly olefinic" is intended to indicate a hydrocarbon admixture which in addition to monoolefinic hydrocarbons contains at least five mole percent of unsaturated hydrocarbons containing double bonded carbon atoms and an additional at least one mole percent of acetylene hydrocarbons containing triple bonded carbon atoms. The preferred feed streams for utilization of the subject process will contain significantly more of both types of unsaturated hydrocarbons. Preferably, the total concentration of unsaturated hydrocarbons will exceed 20 mole percent in the hydrocarbon feed stream. The concentration of acetylene hydrocarbons can exceed 2 mole percent. In some feed streams the concentration of olefinic hydrocarbons may be over 12 mole percent and the concentration of acetylene hydrocarbons may be over 4 mole percent. The subject invention is well suited to the processing of such streams.

The processing of these highly olefinic streams in a system in which the feed hydrocarbon is brought into contact with an aqueous alkaline solution, commonly referred to as "caustic", is hindered by the increased solubility of unsaturated hydrocarbons in the caustic. For instance, propene is about four times as soluble as propane in the caustic solution at 100 degrees F., and propyne is about 35 times more soluble in the caustic than propane. The caustic solution which is circulated through the preferred treating method will therefore pick up a small but significant amount of the unsaturated hydrocarbons in the mercaptan extraction zone. When these unsaturated hydrocarbons are passed into the mercaptan conversion zone, the result is likely to be severe polymerization which will make the caustic regeneration economically unfeasible. For this reason, the preferred form of the mercaptan extraction and oxidation process has not been widely applied to hydrocarbon feed streams rich in diolefins and acetylenes. It should be pointed out that when the hydrocarbon feed stream being treated contains only small quantities of these reactive unsaturated hydrocarbons the concentration of the unsaturated hydrocarbons dissolved in the rich caustic solution can be ignored.

In the subject process, the problems associated with the dissolution of unsaturated hydrocarbons in the rich caustic stream is overcome by the novel step of extracting hydrocarbons from the rich caustic stream prior to regeneration. This extraction step is performed in a new extraction zone not previously employed in the art. In this extraction step, the rich caustic is contacted with a hydrocarbon stream under conditions which result in a transfer of a necessary percentage of the unsaturated hydrocarbons into the hydrocarbon stream employed in this washing or cleansing step. The concentration of unsaturated hydrocarbons in the rich caustic stream may thereby be reduced to a level which is acceptable for passage of the rich caustic into the mercaptan conversion zone.

It must be noted that during the extraction step performed to remove unsaturated hydrocarbons from the rich caustic that there will be a simultaneous extraction of mercaptans from the rich caustic into the hydrocarbon stream employed in this step. This will thereby contaminate the hydrocarbon stream being used with mercaptans. The hydrocarbon stream may, however, be passed into the overall petroleum refining complex at a point upstream of the mercaptan treating facilities to thereby recover the hydrocarbon stream and eventually reject the mercaptans as by recycling them to the hydrocarbon extraction zone.

The operation of the subject process may be discerned by reference to the drawing. In the preferred embodiment of the process shown in the drawing a feed stream comprising a mixture of $C_3$ and $C_4$ paraffins, $C_3$ and $C_4$ olefins and $C_3$ and $C_4$ acetylene hydrocarbons is passed into the bottom of an extraction column 2 through line 1. The hydrocarbon stream passes upward through the liquid-liquid extraction trays preferably provided in the column 2 rising countercurrent to a descending stream of an aqueous alkaline solution referred to herein as caustic. During passage upward through the extraction column 2, mercaptans originally present in the feed stream transfer into the descending caustic, which results in removal of the mercaptans to a very low level and the production of a treated stream removed from the process in line 3. The lean caustic is fed near the top of the extraction column through line 4 and the rich or mercaptan containing caustic is removed from the bottom of a column through line 5. The rich caustic is admixed with a hydrocarbon stream carried by line 24 and passed through line 6. An in-line static mixer 7 is provided to assure intimate contact between the caustic and the hydrocarbon stream of line 24 prior to the passage of this admixture into a settling vessel 8. The settling vessel 8 functions as a phase separation zone wherein the less dense hydrocarbon phase is separated from the denser aqueous alkaline solution. During contacting in line 6 and the mixer 7 the concentration of unsaturated hydrocarbons in the rich caustic solution is greatly reduced. These unsaturated hydrocarbons and some mercaptans enter the naphtha hydrocarbon stream of line 24 and form a used naphtha stream removed from the process in line 9.

This second extraction step produces a treated mercaptan-rich aqueous alkaline solution removed from the phase separation zone through line 10 and admixed with air from line 11 before being passed through line 12 into the oxidation reactor 13. The catalytic oxidation reaction, which is described in greater detail below, is the preferred form of mercaptan conversion. The reaction which occurs within the reactor 13 converts the mercaptan compounds present in the rich caustic into hydrocarbon soluble disulfide compounds. The effluent stream of the oxidation reactor, which comprises an admixture of any residual oxygen or other vapors, the aqueous alkaline solution and disulfide compounds, is passed through line 14 into a three-phase separator 16. In this separator, the gases such as residual oxygen and nitrogen from the air stream from line 11 are vented off through line 15. The disulfides are relatively insoluble in the aqueous alkaline solution and may therefore be separated by decantation and withdrawn from the process through line 18.

There remains a denser now mercaptan-lean aqueous alkaline solution which is withdrawn from the separator 17 through line 19. This mercaptan-lean alkaline solution is admixed with a clean naphtha stream from line 20 during passage through line 22 and the in-line static mixing device 21. This provides a third extraction operation used to remove disulfides from the caustic. The resultant admixture of the naphtha and lean caustic solution is passed into the settler vessel 23 which functions as a phase separation zone. By the judicious selection of an adequate settling time combined with the quiescent conditions maintained within the settler 23 and possibly the provision of internal coalescing means the naphtha may be essentially completely separated from the aqueous alkaline solution. This results in the production of regenerated aqueous alkaline solution which is then passed into the mercaptan extraction column 2 through line 4.

The naphtha of line 20 is admixed with the lean aqueous alkaline solution withdrawn from the separator 17 for the purpose of removing residual amounts of disulfide compounds from the aqueous alkaline solution. This technology, which is employed in the prior art, is often referred to as a naphtha wash to remove "reentry sulfur" from the aqueous alkaline solution. Removing the disulfide compounds from the caustic in this manner prevents the disulfides from becoming dissolved in the treated product stream of line 3 and thereby reduces the overall sulfur content of the product.

In the preferred flow shown in the drawing the clean naphtha stream of line 20 passes through the mixing-settling stage employed to remove disulfide compounds from the lean caustic solution and is then passed in series flow into the mixing-settling step employed to extract unsaturated hydrocarbons from the rich caustic. The same hydrocarbon stream is therefore employed for both extraction steps. However, different hydrocarbon streams may be employed for each of the extraction steps. In some instances this may in fact be desired depending on such factors as the availability of the hydrocarbon streams and the methods chosen for their treating or disposal. The composition of the hydrocarbon stream(s) employed in the extraction steps 5 will be determined by a number of factors such as the availability of hydrocarbon streams at the process location, the means available for treating hydrocarbon streams which become contaminated with disulfides and/or mercaptan compounds, and the desirability of using the various hydrocarbon distillates. The latter factor will be based upon such variables as the solubility of disulfide compounds and perhaps more importantly on the solubility of the olefinic and acetylene hydrocarbons in the treating hydrocarbon streams versus the solubility of the mercaptans in these streams. It would normally be preferred to employ a hydrocarbon stream which will minimize the extraction of mercaptans from the rich caustic while maximizing the extraction of unsaturated hydrocarbons. It will normally be preferred to employ as the wash hydrocarbon stream a hydrocarbon or hydrocarbon admixture having a higher average molecular weight than the feed stream which is being treated in the overall process. The hydrocarbon streams which may be employed in the second and third extraction steps may therefore be chosen from a wide variety of hydrocarbons including $C_3$ hydrocarbons, mixtures of $C_3$ and $C_4$ hydrocarbons, naphtha fractions, and various intermediate hydrocarbon mixtures.

The composition of the feed stream to the subject process will basically be determined by whether or not the feed hydrocarbons are amenable to treatment by extraction with an aqueous alkaline solution. The feed streams will therefore be highly olefinic hydrocarbons ranging from $C_3$ to possibly kerosene boiling point range hydrocarbon mixtures. The preferred feed streams are relatively light hydrocarbons such as $C_3$ hydrocarbons, a mixture of $C_3$ and $C_4$ hydrocarbons, or a mixture of $C_3$ to $C_6$ hydrocarbons. Each of these mixtures would contain both olefinic and paraffinic hydrocarbons.

The subject invention may be accordingly characterized as a process for treating hydrocarbon feed streams by removing mercaptans which comprises the steps of contacting a feed stream which comprises a saturated feed hydrocarbon having a boiling point below about 230° C. and which also comprises at least 5 mole percent olefinic hydrocarbons and at least 1 mole percent diolefinic and acetylene hydrocarbons with a hereinafter characterized regenerated aqueous alkaline solution in a first extraction zone and thereby forming a product hydrocarbon stream and a mercaptan-rich aqueous alkaline solution which comprises a minor concentration of diolefinic hydrocarbons and acetylene hydrocarbons; removing diolefinic and acetylene hydrocarbons from the mercaptan-rich aqueous alkaline solution by contacting the mercaptan-rich aqueous alkaline solution with a treating hydrocarbon stream in a second extraction zone and thereby forming a treated mercaptan-rich aqueous alkaline solution; passing the treated mercaptan-rich aqueous alkaline solution and oxygen into an oxidation zone where mercaptans are catalytically converted to disulfides and producing an oxidation zone effluent stream which comprises disulfides and an aqueous alkaline solution; removing a great majority of the disulfides from the oxidation zone effluent stream by phase separation in a phase separation zone, and thereby forming a mercaptan-lean aqueous alkaline solution; removing additional disulfides from the mercaptan-lean aqueous alkaline solution by contact with a wash hydrocarbon stream in a third extraction zone and thereby forming said regenerated aqueous alkaline solution, which is passed into the first extraction zone.

The subject extraction process may utilize any alkaline reagent which is capable of extracting mercaptans from the feed stream at practical operating conditions and which may be regenerated in the manner described. A preferred alkaline reagent comprises an aqueous solution of an alkaline metal hydroxide, such as sodium hydroxide or potassium hydroxide. Sodium hydroxide, commonly referred to as caustic, may be used in concentrations of from 1 to 50 wt. %, with a preferred concentration range being from about 5 to about 25 wt. %. Optionally, there may be added an agent to increase the solubility of the mercaptans in the solution, typically methanol or ethanol although others such as phenol, cresol or butyric acid may be used.

The conditions employed in the first extraction zone may vary greatly depending on such factors as the nature of the hydrocarbon stream being treated and its mercaptan content, etc. In general, the mercaptan extraction may be performed at an ambient temperature above about 60 degrees Fahrenheit and at a pressure sufficient to ensure liquid state operation. With very light material in the feed stream, this may be impractical and the extraction is performed with a vapor phase feed stream. The pressure may range from atmospheric up to 6895 kPag (1000 psig) or more, but a pressure in the range of from about 1000 to 2400 kPag (145 to about 348 psig) is preferred.

The temperature in the mercaptan extraction zone is confined within the range of 10 to 121 degrees Celsius (50 to 250 degrees Fahrenheit), preferably from 27 to 49 degrees Celsius (80 to 120 degrees Fahrenheit). The ratio of the volume of the alkaline solution required per volume of the feed stream will vary depending on the mercaptan content of the feed stream. Normally this ratio will be between 0.01:1 and 1:1, although other ratios may be desirable. The rate of flow of the alkaline solution will typically be about 1 to 3% of the rate of flow of an LPG stream and may be up to about 20% of a light straight run naphtha stream. The extraction zone is preferably a verticaly trayed column having a large number of circular perforations. Optimum extraction in this liquid system is obtained with a velocity through the perforations of from about 5 to about 10 feet per second. A packed column and other types of extraction equipment could be employed if desired. One particularly preferred type of contacting apparatus is the "fiber-film" contacting systems such as described in U.S. Pat. No. 4,491,565 which is incorporated herein by reference. Essentially all of the extractable mercaptans should be transferred to the alkaline solution from the feed stream. As used herein, the term "essentially all" is intended to refer to at least 85% and preferably 95% of all the material referred to.

Proper operation of the extraction zone results in the formation of the mercaptan-containing or rich caustic stream. Preferably, this stream is mixed with an air stream supplied at a rate which supplies at least the stoichiometric amount of oxygen necessary to oxidize the mercaptans in the alkaline stream. The air or other oxidizing agent is well admixed with the liquid alkaline stream and the mixed-phase admixture is then passed into the oxidation zone. The oxidation of the mercaptans is promoted through the presence of a catalytically effective amount of an oxidation catalyst capable of functioning at the conditions found in the oxidizing zone. Several suitable materials are known in the art. Preferred as a catalyst is a metal phthalocyanine such as cobalt phthalocyanine or vanadium phthalocyanine, etc. Higher catalytic activity may be obtained through the use of a polar derivative of the metal phthalocyanine, especially the monosulfo, disulfo, trisulfo, and tetrasulfo derivatives.

The preferred oxidation catalysts may be utilized in a form which is soluble or suspended in the alkaline solution or it may be placed on a solid carrier material. If the catalyst is present in the solution, it is preferably cobalt or vanadium phthalocyanine disulfonate at a concentration of from about 5 to 1000 wt. ppm. Carrier materials should be highly absorptive and capable of withstanding the alkaline environment. Activated charcoals have been found very suitable for this purpose, and either animal or vegetable charcoals may be used. The carrier material is to be suspended in a fixed bed which provides efficient circulation of the alkaline solution. Preferably the metal phthalocyanine compound comprises about 0.1 to 2.0 wt. % of the final composite. More detailed information on liquid-phase catalysts and their usage may be obtained from U.S. Pat. Nos. 2,853,432 and 2,882,224. An alternative type of catalyst composition is described in previously cited U.S. Pat. No. 3,923,645 and in U.S. Pat. Nos. 4,069,138; 4,120,865; and 4,243,551.

Likewise, further information on fixed bed operations is contained in U.S. Pat. Nos. 2,988,500; 3,108,081; and 3,148,156. The oxidation conditions utilized include a pressure of from atmospheric to about 6895 kPag (1000 psig), and preferably are substantially the same as used in the downstream phase disulfide-caustic separation zone. This pressure is normally less than 500 kPag (72.5 psig). The temperature may range from ambient to about 95 degrees Celsius (203 degrees Fahrenheit) when operating near atmospheric pressure and to about 205 degrees Celsius (401 degrees Fahrenheit) when operating at superatmospheric pressures. In general, it is preferred that a temperature within the range of about 38 to about 80 degrees Celsius is utilized. The oxidation zone preferably contains a packed bed to ensure intimate mixing. This is done in all cases, including when the catalyst is circulated with the alkaline solution.

The phase separation zone may be of any suitable configuration, with a settler such as represented in the drawing being preferred. It is desirable to run the phase separation zone at the minimum pressure which other design considerations will allow. This is to promote the transfer of the excess oxygen, nitrogen and water into the vapor phase. The pressure in the phase separation zone may range from atmospheric to about 2068 kPag (300 psig) or more, but a pressure in the range of from about 65 to 300 kPag is preferred. The temperature in this zone is confined within the range of from about 10 to about 120 degrees Celsius (50 to 248 degrees Fahrenheit), and preferably from about 26 to 54 degrees Celsius. The phase separation zone is sized to allow the denser alkaline solution to separate by gravity from the disulfide compounds. This may be aided by a coalescing means located in the zone.

The previous discussion has focused upon the conversion of the extracted mercaptans into disulfide compounds in an oxidation zone. The invention however can be applied to other types of mercaptan regeneration systems in which the mercaptan is converted into some other preferably hydrocarbon soluble sulfur-containing chemical compound. It is preferred that the product sulfur-containing compound is hydrocarbon soluble to allow its removal by extraction from the regenerated caustic. Unless separation by means other than decantation can be employed, it is a requirement that the product sulfur-containing compound is not soluble in an aqueous alkaline solution and preferably readily separates from such a solution.

The equipment employed in the extraction of compounds from the caustic stream, that is in the second and third extraction zones, is also subject to variation. The preferred form of the equipment is as shown in the drawing and comprises a static mixer, of which several types are readily available, to produce cocurrent mixing of the hydrocarbon and caustic streams. Following this admixing step, the two liquid phases are separated in a settling vessel. Those skilled in the art will recognize that this contacting-separation sequence can be performed in a number of different types of equipment including various single stage and multistage equipment. Therefore, extraction columns employing packing or contacting plates as preferred for the mercaptan extraction column could be employed. The two liquid phases may also be brought into contact through the use of moving mechanical agitators or mixers although this is not preferred.

The following example is based upon the projected operation of a commercial scale mercaptan-extraction process based upon past operation and design experience obtained from other commercial units processing feed stocks of similar natures but not having a high diolefinic and acetylene hydrocarbon content. The flow scheme is similar to that of the Drawing. The feed stream would be a hydrocarbon stream comprising about 42 mole percent butadiene and butynes, 25 mole percent vinyl acetylene, 8 mole percent propyne, and 25 mole percent of $C_3$ and $C_4$ olefins and paraffins. This feed stream contains about 300 weight ppm mercaptan sulfur and is treated by countercurrent contacting in a trayed extraction column in the manner previously set out herein. The resultant rich caustic contains about 4200 weight ppm mercaptan sulfur and about 1.0 volume percent dissolved reactive acetylene rich hydrocarbons. The rich caustic passes to a second contactor wherein it is contacted with 50 volume percent of a sweet butane-butylenes stream. The hydrocarbon content of the rich caustic is reduced to about 0.1 volume percent of mainly butanes and butylenes from the hydrocarbon wash stream and the mercaptan sulfur content of the caustic is reduced to about 3900 weight ppm. The $C_4$ hydrocarbon stream picks up about 80 weight ppm mercaptan sulfur plus about 2 mole percent of highly olefinic acetylene rich hydrocarbons. The resulting wash hydrocarbon stream containing approximately 400 weight ppm disulfide sulfur, 80 weight ppm mercaptan sulfur and 2 volume percent dienes plus acetylenes is then routed to a suitable product storage facility or fed back to upstream fractionation facilities for recovery. The rich caustic substantially free of dienes and acetylenes but containing some butane and butylene type hydrocarbons at about 0.1 volume percent is fed to the oxidative regeneration section. The regenerated caustic recovered from this conversion zone is treated in a third contactor with 50 volume percent of a sweet butane-butylene stream. The extractable sulfur content of the regenerated or lean caustic stream is reduced to trace amounts while the hydrocarbon stream picks up disulfide sulfur. The caustic stream is then passed into the mercaptan extraction section, and the hydrocarbon stream is then employed in the third extraction zone to remove acetylene hydrocarbons.

I claim as my invention:

1. A process for treating hydrocarbon feed streams by removing mercaptans which comprises the steps of:

(a) contacting a feed stream which comprises a saturated feed hydrocarbon having a boiling point below about 230 degrees Celsius and which also comprises at least 5 mole percent olefinic hydrocarbons and at least 1 mole percent total diolefinic and acetylene hydrocarbons with a hereinafter characterized regenerated aqueous alkaline solution in a first extraction zone and thereby forming a product hydrocarbon stream and a mercaptan-rich aqueous alkaline solution which comprises diolefinic hydrocarbons and acetylene hydrocarbons;

(b) removing diolefinic and acetylene hydrocarbons from the mercaptan-rich aqueous alkaline solution by contacting the mercaptan-rich aqueous alkaline solution with a treating hydrocarbon stream in a second extraction zone and thereby forming a treated mercaptan-rich aqueous alkaline solution;

(c) passing the treated mercaptan-rich aqueous alkaline solution into a mercaptan conversion zone in which mercaptans are converted to hydrocarbon soluble sulfur-containing chemical compounds, and producing a conversion zone effluent stream which comprises said sulfur-containing chemical compounds and an aqueous alkaline solution; and (d) separating a majority of said sulfur-containing chemical compounds from the conversion zone effluent stream in a separation zone and thereby forming said regenerated aqueous alkaline solution.

2. The process of claim 1 further characterized in that the feed stream comprises a $C_3$ to $C_6$ olefinic hydrocarbon and a $C_3$ to $C_6$ paraffinic hydrocarbon.

3. The process of claim 2 further characterized in that the feed stream comprises over 12 mole percent olefinic hydrocarbons.

4. The process of claim 3 further characterized in that the feed stream contains over 4 mole percent acetylene hydrocarbons.

5. A process for treating hydrocarbon feed streams by removing mercaptans which comprises the steps of:

(a) contacting a feed stream which comprises a saturated feed hydrocarbon having a boiling point below about 230° C. and which also comprises at least 5 mole percent olefinic hydrocarbons and at least 1 mole percent acetylene hydrocarbons with a hereinafter characterized regenerated aqueous alkaline solution in a first extraction zone and thereby forming a product hydrocarbon stream and a mercaptan-rich aqueous alkaline solution which comprises acetylene hydrocarbons;

(b) removing acetylene hydrocarbons from the mercaptan-rich aqueous alkaline solution by contacting the mercaptan-rich aqueous alkaline solution with a treating hydrocarbon stream in a second extraction zone and thereby forming a treated mercaptan-rich aqueous alkaline solution;

(c) passing the treated mercaptan-rich aqueous alkaline solution into a mercaptan conversion zone in which mercaptans are converted to hydrocarbon soluble sulfur-containing chemical compounds, and producing a conversion zone effluent stream which comprises said sulfur-containing chemical compounds and an aqueous alkaline solution;

(d) separating a majority of said sulfur-containing chemical compounds from the conversion zone effluent stream in a separation zone and thereby forming a mercaptan-lean aqueous alkaline solution comprising minor amounts of said sulfur-containing chemical compounds; and, (e) removing sulfur-containing chemical compounds from the mercaptan-lean aqueous alkaline solution by contacting the mercaptan-lean aqueous alkaline solution with a wash hydrocarbon stream in a third extraction zone and thereby forming said regenerated aqueous alkaline solution, which is passed into the first extraction zone.

6. The process of claim 5 further characterized in that after having been contacted with the mercaptan-lean aqueous alkaline solution the wash hydrocarbon stream is passed into the second extraction zone and is employed as the treating hydrocarbon stream.

7. The process of claim 5 further characterized in that said hydrocarbon soluble sulfur-containing chemical compounds are disulfides.

8. The process of claim 5 further characterized in that the feed stream comprises a $C_2$ to $C_6$ olefinic hydrocarbon and a $C_2$ to $C_6$ paraffinic hydrocarbon.

9. The process of claim 8 further characterized in that the feed stream comprise over 12 mole peroent olefinic hydrocarbons.

10. The process of claim 9 further characterized in that the feed stream contains over 4 mole percent acetylene hydrocarbons.

11. The process of claim 9 further characterized in that oxygen is also passed into the mercaptan conversion zone.

12. The process of claim 11 further characterized in that the hydrocarbon soluble sulfur-containing chemical compounds are disulfides.

13. A process for treating hydrocarbon feed streams by removing mercaptans which comprises the steps of:

(a) contacting a feed stream which comprises a saturated feed hydrocarbon having a boiling point below about 230° C. and which also comprises at least 5 mole percent olefinic hydrocarbons and at least 1 mole percent acetylene hydrocarbons with a hereinafter characterized regenerated aqueous alkaline solution in a first extraction zone and thereby forming a product hydrocarbon stream and a mercaptan-rich aqueous alkaline solution which comprises diolefinic hydrocarbons and acetylene hydrocarbons;

(b) removing diolefinic and acetylene hydrocarbons from the mercaptan-rich aqueous alkaline solution by contacting the mercaptan-rich aqueous alkaline solution with a treating hydrocarbon stream in a second extraction zone and thereby forming a treated mercaptan-rich aqueous alkaline solution;

(c) passing the treated mercaptan-rich aqueous alkaline solution and oxygen into an oxidation zone where mercaptans are converted to disulfides and producing an oxidation zone effluent stream which comprises disulfides and an aqueous alkaline solution;

(d) removing a great majority of the disulfides from the oxidation zone effluent stream by phase separation in a phase separation zone, and thereby forming a mercaptan-lean aqueous alkaline solution; and, (e) removing additional disulfides from the mercaptan-lean aqueous alkaline solution by contact with a wash hydrocarbon stream in a third extraction zone and thereby forming said regenerated aqueous alkaline solution, which is passed into the first extraction zone.

14. The process of claim 13 further characterized in that an oxidation catalyst is present. in the oxidation zone.

15. The process of claim 14 further characterized in that an oxidation catalyst is supported as a bed of solid material located within the oxidation zone.

16. The process of claim 14 further characterized in that an oxidation catalyst is dissolved in the aqueous alkaline solution.

17. The process of claim 16 further characterized in that the feed stream comprises at least one $C_2$ to $C_6$ olefinic hydrocarbon and at least one $C_2$ to $C_6$ paraffinic hydrocarbon.

18. The process of claim 17 further characterized in that the feed stream comprises over 4 mole percent $C_6$ minus acetylene hydrocarbons.

19. The process of claim 18 further characterized in that the feed stream contains over 12 mole percent $C_6$ minus acetylene hydrocarbons.

20. The process of claim 19 further characterized in that the oxidation catalyst comprises a metal phthalocyanine compound.

21. The process of claim 14 further characterized in that the wash hydrocarbon stream is passed into the second extraction zone and is employed as the treating hydrocarbon stream after having been contacted with the mercaptan-lean aqueous alkaline solution.

22. The process of claim 14 further characterized in that sulfur-free oxygenated hydrocarbonaceous compounds are produced in the oxidation zone, and in that at least a portion of said oxygenated compounds which become entrained in the mercaptan-lean aqueous alkaline solution are removed from the mercaptan-lean aqueous alkaline solution by contact with the wash hydrocarbon stream in the third contacting zone.

23. The process of claim 13 further characterized in that the feed stream contains over 20 mole percent olefinic hydrocarbons.

24. The process of claim 23 further characterized in that the feed stream contains over 2 mole percent acetylene hydrocarbons.

* * * * *